United States Patent [19]

Morris

[11] Patent Number: 4,553,561

[45] Date of Patent: Nov. 19, 1985

[54] DEVICE FOR THE PREVENTION OF FLOODING FROM DRAINAGE SYSTEMS

[76] Inventor: Daniel C. Morris, 1450 W. 71st St., Downers Grove, Ill. 60516

[21] Appl. No.: 623,476

[22] Filed: Jun. 22, 1984

[51] Int. Cl.[4] ..... E03F 5/12; A47K 1/14

[52] U.S. Cl. ..... 137/362; 137/357; 220/5 A; 220/DIG. 3; 417/40; 285/158

[58] Field of Search ..... 137/593, 356, 357, 364, 137/371, 373; 4/427, 508; 220/4 C, 5 A, 4 D; 285/158, 159; 417/40

[56] References Cited

U.S. PATENT DOCUMENTS

| | | | |
|---|---|---|---|
| 205,123 | 6/1878 | Müller | 285/158 |
| 349,735 | 9/1886 | Nicaise | 52/169.5 |
| 997,835 | 7/1911 | Lane | 52/169.5 |
| 1,459,327 | 6/1923 | Flath | 137/371 |
| 2,427,258 | 9/1947 | Cavalieri | 137/593 |
| 2,592,419 | 4/1952 | Harper et al. | 220/5 A |
| 2,764,545 | 9/1956 | Primich | 220/5 A |
| 2,813,692 | 11/1957 | Bremer et al. | 285/158 |
| 2,816,574 | 12/1957 | Bots | 137/593 |
| 3,425,175 | 2/1969 | Gerde | 52/169 |
| 4,004,706 | 1/1977 | Guldenfels et al. | 220/DIG. 3 |
| 4,075,800 | 2/1978 | Molick | 52/169.5 |
| 4,089,139 | 5/1978 | Moffa | 52/20 |
| 4,171,186 | 10/1979 | Chapman | 417/40 |
| 4,180,094 | 12/1979 | Vitagh | 137/362 |
| 4,247,134 | 1/1981 | Yergen | 285/158 |

FOREIGN PATENT DOCUMENTS

| | | | |
|---|---|---|---|
| 220119 | 3/1910 | Austria | 137/364 |

*Primary Examiner*—A. Michael Chambers

*Attorney, Agent, or Firm*—Dressler, Goldsmith Shore, Sutker & Milnamow, Ltd.

[57] ABSTRACT

A novel device for the control of flooding from drainage system overflow and a method of use are disclosed. The device is useful for limiting overflow from drainage structures, such as a sump well or sewer drain. The device includes at least one container segment that defines an enclosure for retaining excess flood water. The device also includes a cover and means for removably mounting the cover on the top of the container segment. Transition means are also provided to sealingly connect the container segment with an element below the container segment. In accordance with a method aspect of this invention, a flood control installation is made by attaching the device to an apron defining the opening about the well.

15 Claims, 9 Drawing Figures

FIG. 4
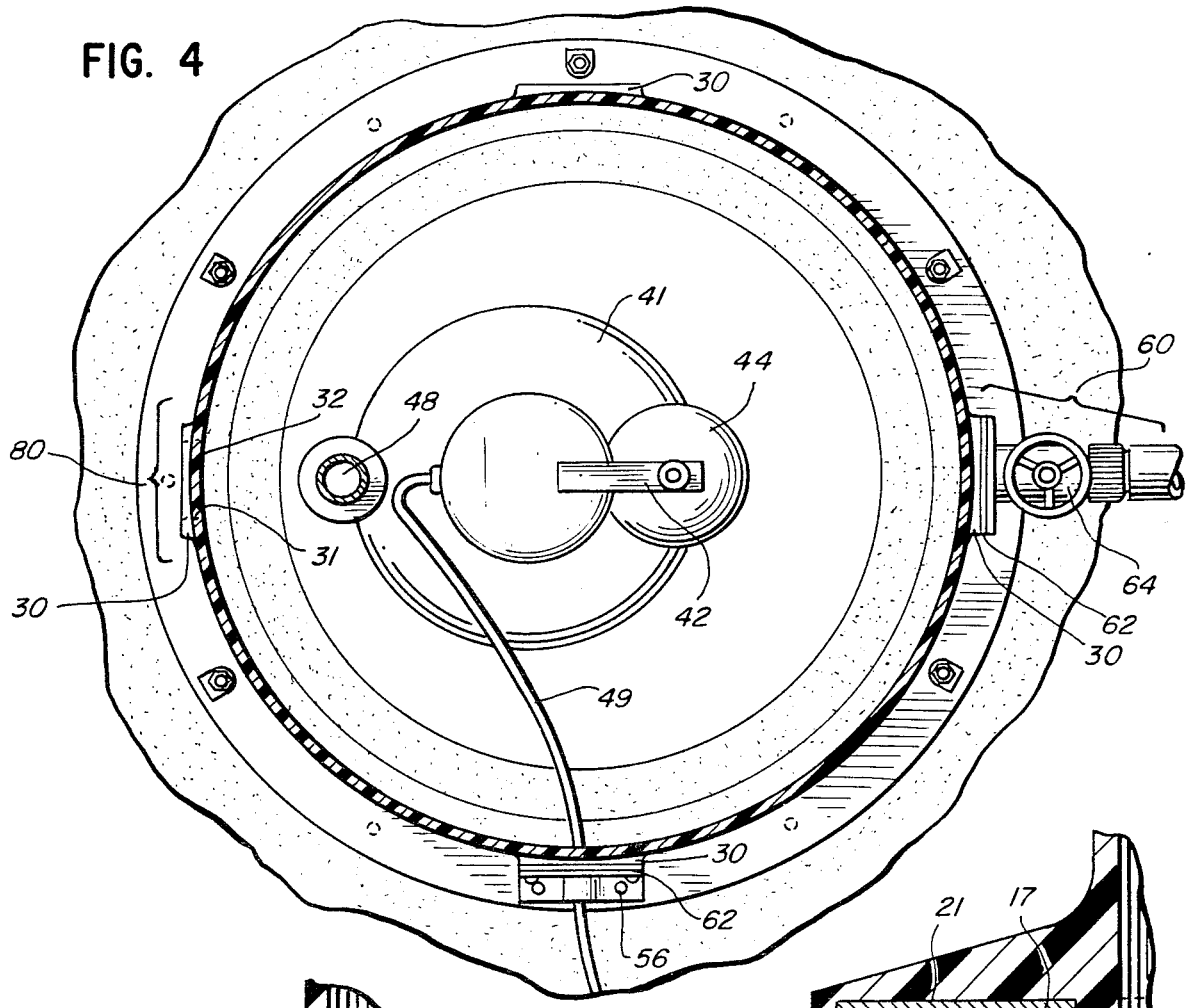
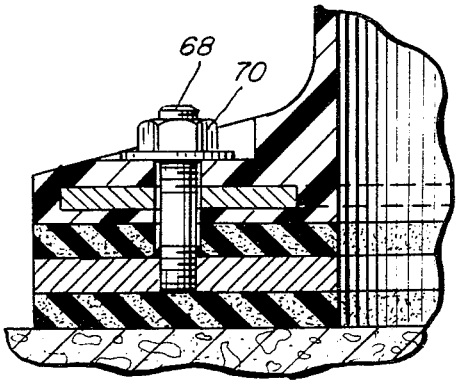
FIG. 5
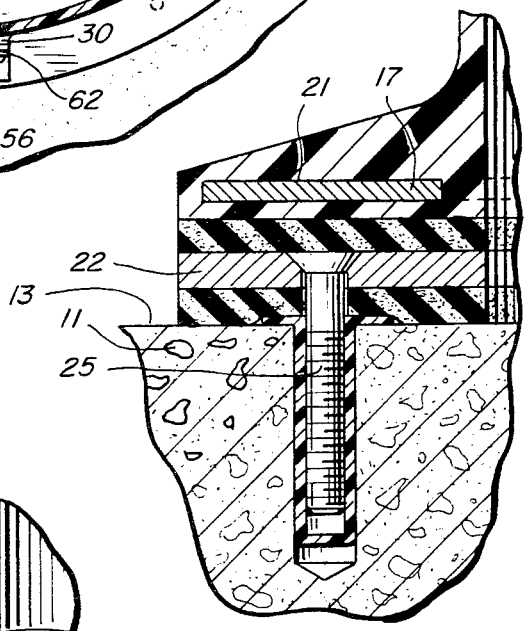
FIG. 6
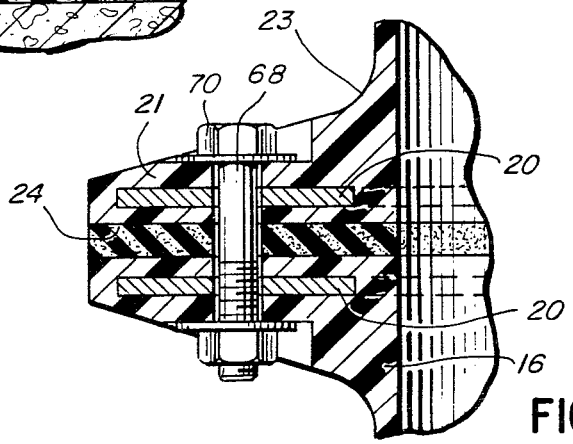
FIG. 7

FIG. 8
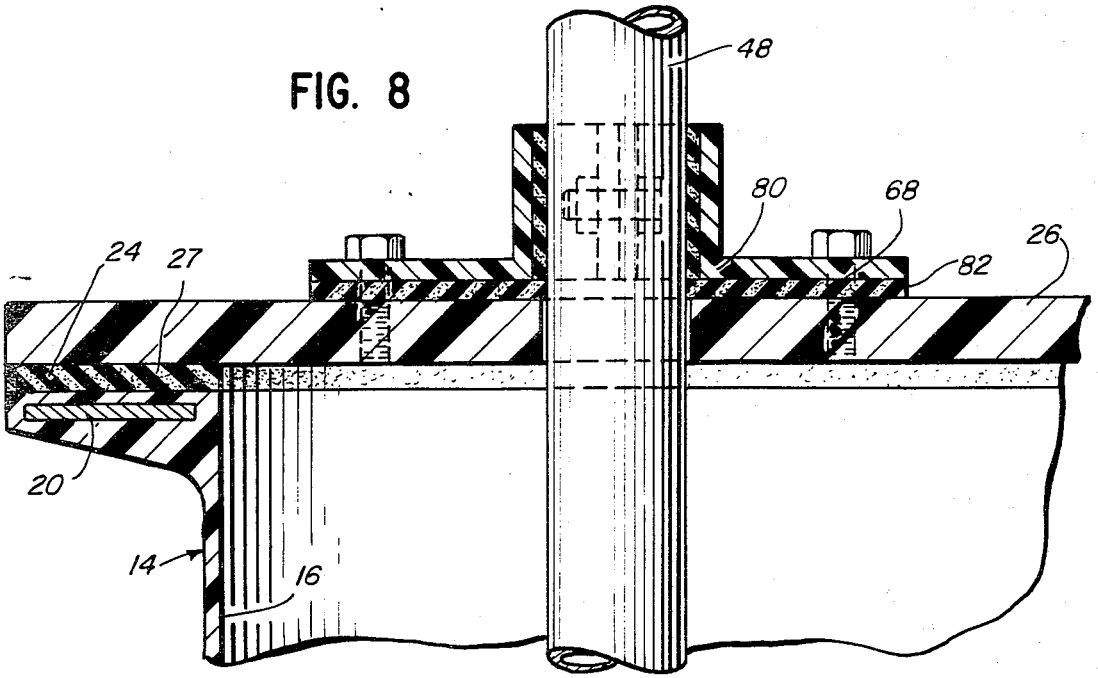
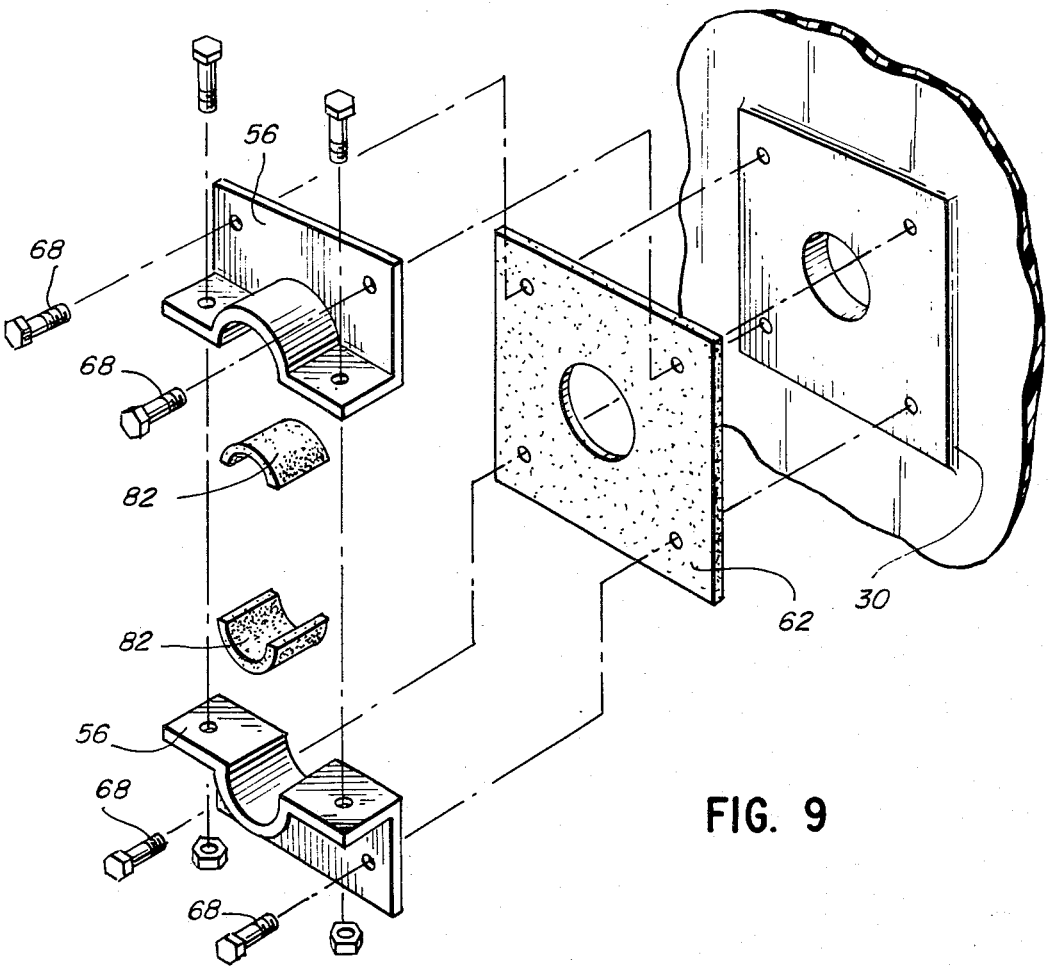
FIG. 9

DEVICE FOR THE PREVENTION OF FLOODING FROM DRAINAGE SYSTEMS

TECHNICAL FIELD OF THE INVENTION

This invention relates to a device used with wells to prevent flooding from drainage system overflow.

BACKGROUND OF THE INVENTION

Sump well overflow is a great concern of property owners. Overflow flooding causes hundreds of thousands of dollars in damage to buildings and personal property each year. While individual flood instances may not be severe, the cumulative damage from repeated flooding and drying causes permanent and severe damage to structures and property. When flooding is a regular occurrance, building occupants may be precluded from any use of valuable space subject to water damage.

The two most common types of flooding in buildings is due to sewer line overflow and sump well overflow. In both cases, overflow water exits from a well and enters the otherwise usable portions of the building. The major difference between sewer and sump overflows is the weather related effects on sump system overflows. Sewer line overflow results from any backup in the sewer line which generates a sufficient head of pressure to force liquid from the drainage system defining a wall.

The most common cause of flooding of sump systems is a large amount of rain received by the surrounding soil when the ground water level surrounding the building is unusually high. In addition, many buildings are located where the normal ground water level is normally elevated. In these situations, any influx of precipitation will result in an increased ground water saturation and inflow into the structure. The typical sump pump system is often unable to remove incoming water rapidly enough to prevent flooding. Sump system overflow can also be caused by a malfunction of the sump pump or other fluid removal device. This can be from electrical failure, motor malfunction, or flooding of a non-submersible pump.

Present devices for sump well overflow control rely on backup systems to control water inflow to the sump system. These systems often employ additional pumping capacity, increased sump well capacity, or modified drainage. However, when there is flooding, these did not prevent overflow from the sump well into the surrounding area. These devices generally use complicated and expensive systems which are subject to failure.

What is needed is a device which works automatically to prevent any sump well or sewer line overflow. The device should provide increased storage capacity and controlled drainage to prevent overflow onto the floor of the building. The present invention meets this desire.

SUMMARY OF THE INVENTION

The present invention relates to a flood control device which limits overflow of flooding from a well. Such a well can be a sump well or the well defined by a sewer drain. A flood control installation is made by attaching the flood control device to an apron which defines the opening about the well.

The flood control device includes at least one container segment which defines an enclosure for retaining excess flood water until it can be easily removed. The device also includes a cover and means for removably mounting the cover on the top of the container segment. Transition means are also provided to sealingly connect the container segment with an element below the container segment. This element can either be the apron about the well or another container segment to provide additional height and water storage area.

Where the element is the apron, the transition means is an attachment means associated with the bottom of the container segment for sealingly mounting the container segment on the apron about the opening. The attachment means preferably includes a thick soft gasket positioned against the apron to provide a fluid-tight seal even with a fairly irregular surface. The attachment means can also include a plurality of mounting bolts for connecting the device to the apron.

Where two or more container segments are used, the transition means between segments is a coupling means. The coupling means is associated with the container segments above and below it for providing a fluid-tight seal between the two container segments. The coupling means preferably includes a gasket and a plurality of bolts for holding the two container segments together. The use of two or more container segments is preferred. Each container segment can then individually have a smaller size thus providing for simplified shipping and installation. A plurality of container segments also allows easy adjustability since the size of the device can be easily changed by adding additional container segments.

Each container segment includes a tubular member having a top end, a bottom end, and a substantially rigid sidewall between the ends. The sidewall is provided with at least one raised planar surface between the ends. This raised planar surface can be used to install a window, an electrical wire inlet, or a water flow outlet. The planar surface is preferably provided with a frangible web about a cutout to provide for easy removal of the cutout and installation of the window, wire, or water outlet flow.

The tubular member defines an enclosure having a cross section which is preferably greater than the cross section of the apron opening. This allows the container segment to be easily installed over the apron without any size reduction element.

The container segment also includes a top flange on the top end of the tubular member and a bottom flange on the bottom end of the tubular member. Each flange extends from the sidewall of the tubular member and defines a sealing surface contiguous with the tubular member. The transition means can then be easily associated with the bottom flange to either connect the container segment to the apron or to another container segment below it.

The cover preferably is of sufficient cross sectional area to seal with the top flange of the upper container segment. This seal can be accomplished by positioning a gasket between the cover and the top flange and using fastening means such as bolts that pass through the cover attached to the upper flange. This compresses the gasket, thereby providing a fluid-tight seal. A complete air-tight seal is preferred for the flood control device. As the water level rises within the device, the air within the device then becomes pressurized providing an additional force against flooding. With such a sealed device, the height of the device need not be sufficient so that the top of the device is equal to the ground level outside the building and still avoid flooding as the pressurized air will exert force on the water column preventing any increase inflow into the structure.

Either because of sewer line backup or excessive ground water saturation, the water level within the well will begin to rise. As the water level reaches the height of the apron, rather than spreading over the floor as would otherwise happen, the water is retained within the enclosure defined by the device. The water level can then rise within the device generating a head of pressure opposing the entrance of additional water into the well. The water is then retained in the flood control device until it can be easily removed. It can be removed through an outlet valve mounted on the planar surface or through a sump pump located within the well. The present invention can be used with the sump pump when excessive ground water inflow temporarily exceeds the capacity of the sump pump.

Numerous other advantages and features of the present invention will become readily apparent to those skilled in the art from the following detailed description of the preferred embodiments of the invention, the drawings, and the appended claims.

BRIEF DESCRIPTION OF THE DRAWINGS

The figures accompanying the description of the inventions are for purposes of illustration. The figures are briefly described as:

FIG. 4 is a plan view in cross section taken along plane 4—4 of FIG. 2 looking down;

FIG. 5 is an enlarged, elevational view taken in cross section along plane 5—5 of FIG. 1 showing a portion of attachment means for mounting the device on the apron;

FIG. 6 is an enlarged, elevational view taken in cross section along plane 6—6 of FIG. 1 showing a portion of the attachment means for mounting the device on the apron;

FIG. 7 is an enlarged, elevational view taken in cross section along plane 7—7 of FIG. 1 showing a coupling means for attaching container segments together;

FIG. 8 is an enlarged, elevational view, partially broken away, showing a fluid-tight seal around the drain pipe opening as it exits the device; and FIG. 9 is an enlarged connector means for attaching a valve device, electrical wire to the side of one of the container segments.

DESCRIPTION OF THE PREFERRED EMBODIMENT

The present invention is a flood control device which can be used as part of an installation to avoid flooding such as it would occur in the basement of a building. The present device works automatically without the need of any backup pump or other complicated arrangement.

Figure 1:
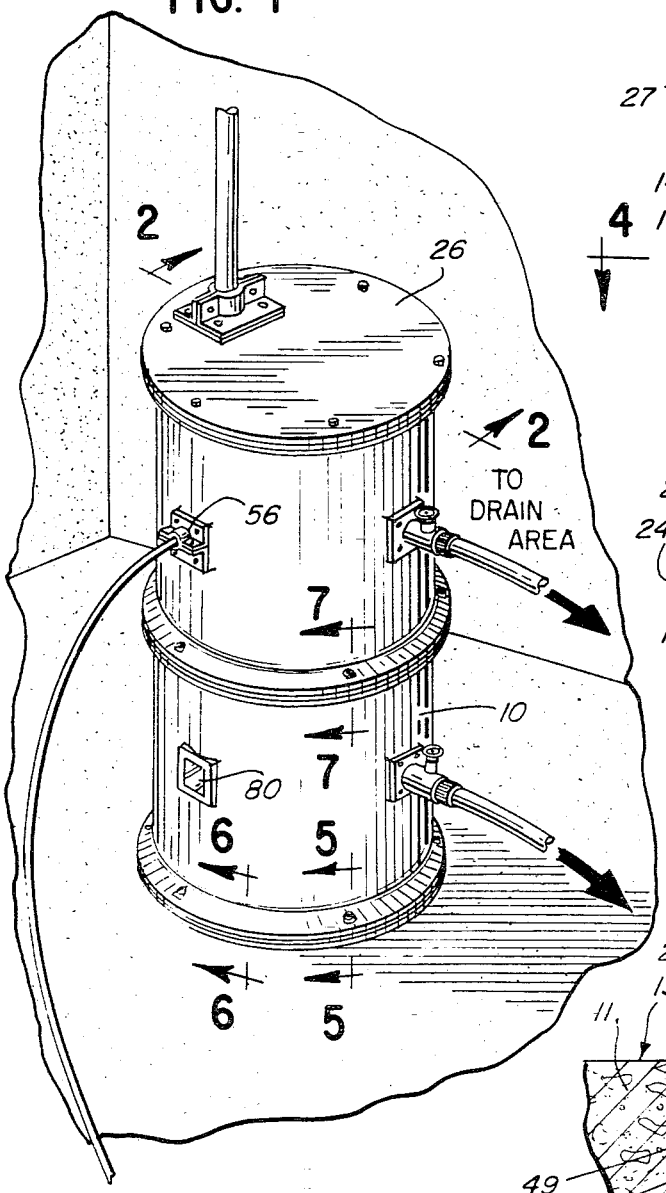
FIG. 1 is a perspective view showing a device of the present invention comprising two container segments shown attached to an apron about a sump well.
Figure 2:
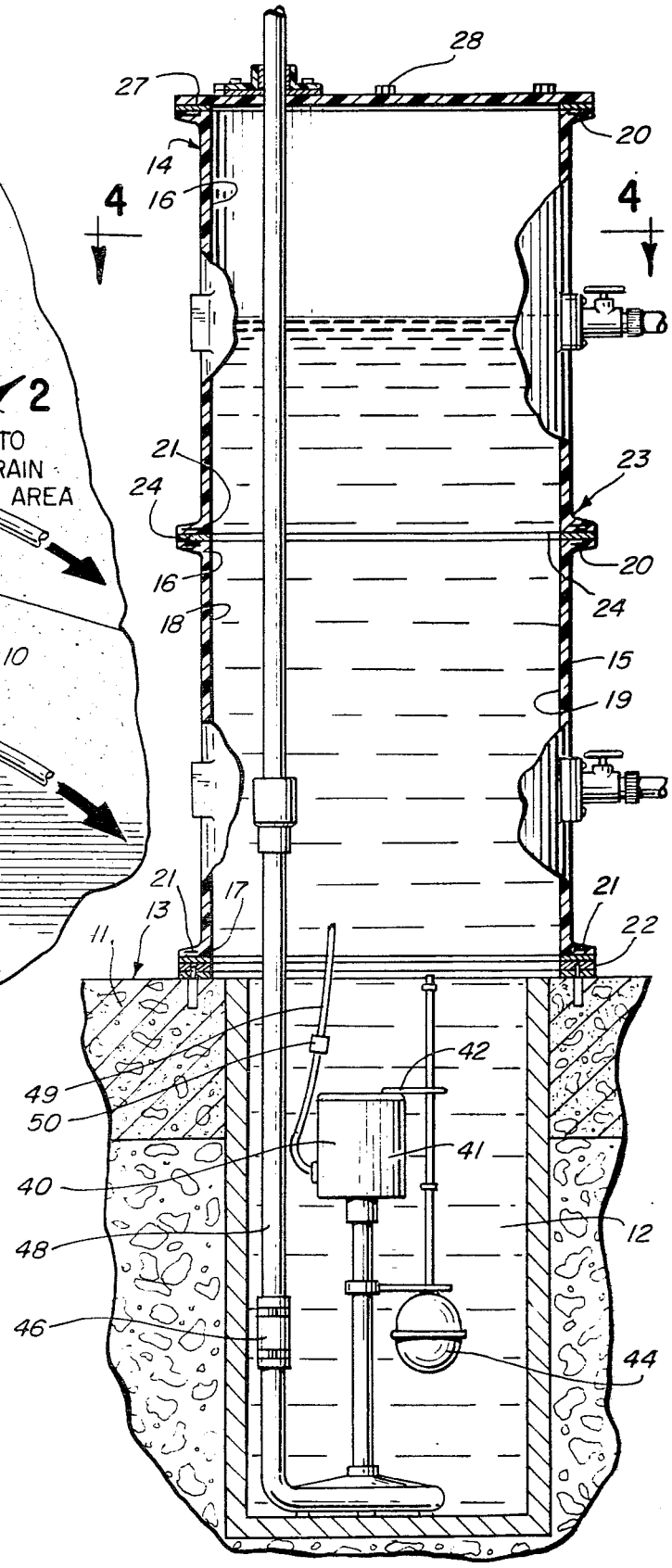
FIG. 2 is an elevational view taken generally in cross section along plane 2—2 of FIG. 1 showing the device mounted over a sump well having a pump with drain pipe.

Referring to FIGS. 1 and 2, the flood control device 10 is shown mounted on an apron 11 around a sump well 12 opening through a floor 13. The flood control device includes at least one, but preferably more than one container segment. As shown, the flood control device 10 includes an upper container segment 14 and a lower container segment 15. Each container segment includes a tubular member having a top end 16, a bottom end 17 and a substantially rigid sidewall 18 between the ends. The container segment defines an enclosure 19 having a cross section between the tubular member ends.

Each container segment also includes a top flange 20 sealingly mounted on the top end 16 and a bottom flange 21 sealingly mounted on the bottom end 17. Each flange extends from the sidewall 18 of the tubular member and preferably extends outwardly of the enclosure.

The flood control device also includes transition means which is associated with the bottom flange 21 to sealingly connect the container segment to an element below it. In the case of container segment 15, the transition means is an attachment means 21 associated with the bottom flange 22 to sealingly mount the lower container segment 15 on the apron 13 about the well opening.

In the case of the upper container segment 14, the transition means is a coupling member 23 which is associated with the bottom flange 21 of the upper container segment 14 and the top flange 20 of the lower container segment 15 to provide a fluid-tight seal between the two container segments. The coupling means 23 and attachment means 21 cooperate with sealing surfaces 24 which are defined by each of the flanges 20 and 21.

The flood control device also includes a cover 26 having a cross section of sufficient size to seal with the top flange 20. Means for removably and preferably also sealingly mounting the cover 26 on the top flange 20 are also provided. This preferably includes a gasket 27 and fastening means such as bolts 28 which extend through the cover and flange for mounting.

Located on the sidewall 18 of the container segment is at least one raised planar surface 30. The planar surface 30 preferably includes a scored template 31 about a cutout 32. This allows the cutout 32 to be easily removed to allow a window, an outlet valve, or an electrical connection to be mounted on the planar surface 30.

FIG. 1 illustrates the most widely used variation of the device, wherein the units of the device are shown placed over a sump well in the installed position. In this, the most preferred embodiment, the tubular members are shown as cylindrical for the purpose of equally distributing the force of any water contained within the device. The device 10 can be of any desired shape as will be necessary to accomodate a variety of installation schemes. In the most preferred embodiment, shown in FIG. 1, the device 10 is shown in place, attached to a sump well opening by means of a transition means located at the bottom of the lowermost unit FIG. 10. A cover 40 is shown held in place by bolts 42.

In FIG. 2, two container segments are shown 14, 15, one connected to the next. The internal cross sectional area is equal for both container segments 14, 15. The transition means is shown, by illustration, with an annular flange 20, 21, into which a reinforcing member 26 is embedded. The transition element is comprised of a gasket 24 in proximal alignment with the annular flange 20, 21. The gasket rests atop the transition means 22, which is affixed to the apron by concrete mollies 22, such as illustrated in FIG. 6 as 25 passing through the attaching ring 22. The concrete mollies are positioned so as to hold the lowermost container segment 15 in such alignment with the sump well 12 so as to completely enclose the opening of the sump well.

Within the sump well 12, a sump pump is shown for purposes of illustration as 40 consisting of a motor 41, a switch 42, and a float 44. The sump well has associated with it a catch valve 46, and a discharge pipe 48. An electrical connection to the sump pump 49 is shown passing into the lowermost tubular member 15, from which it will exit through the planar surface 30 with the appropriate electrical attachment 56. The device will function with a submersible or non-submersible sump pump. For purposes of illustration, the drawings show a non-submersible type of pump.

In FIG. 2, the water level has exceeded the level of the uppermost opening of the sump well (a flood situation) and has risen to the level of valve opening 60. The valve assembly 64 is attached to the planar member 30 associated with a gasket member 62 and held in place by bolts 65.

Figure 3:
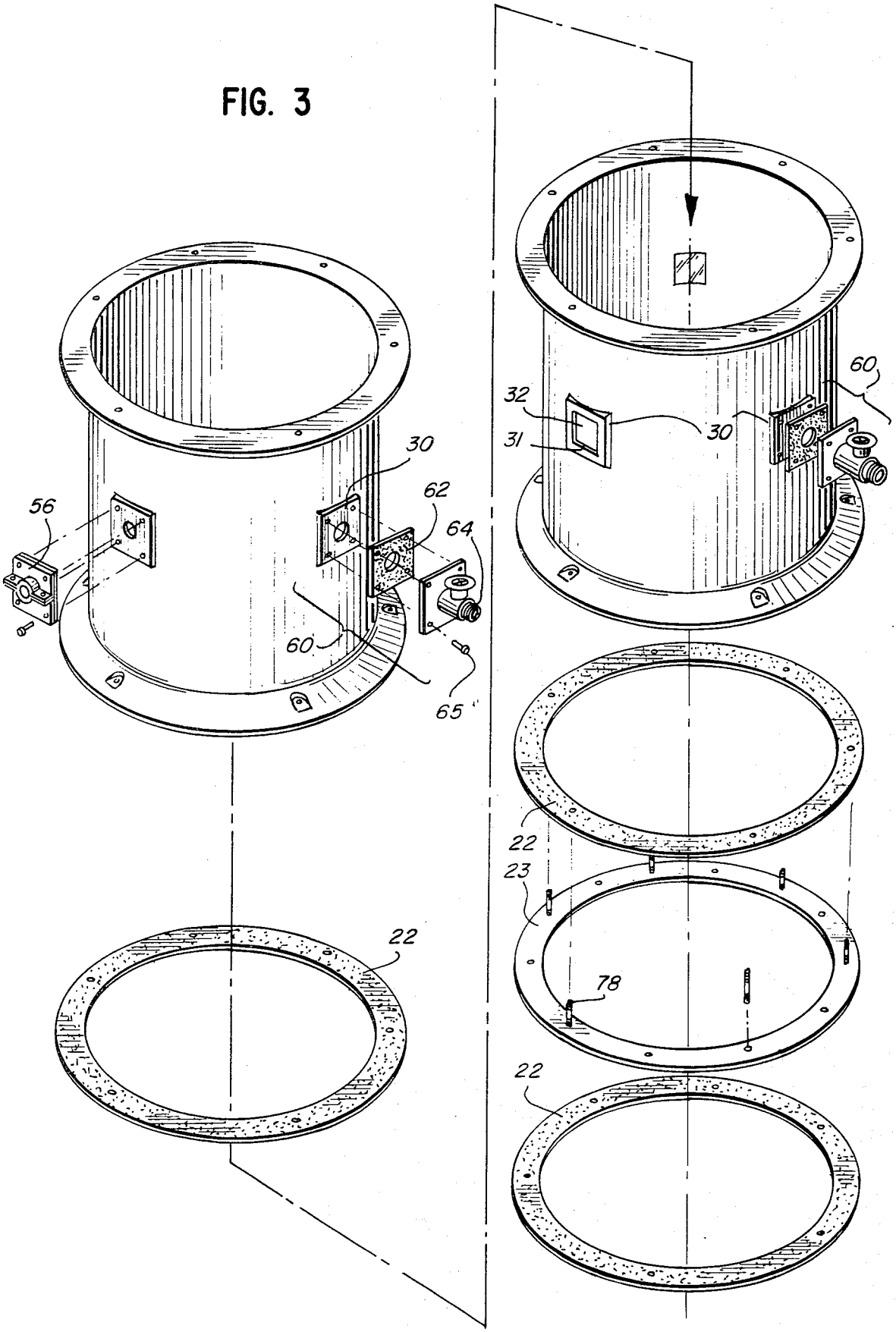
FIG. 3 is an exploded perspective view of the device of FIGS. 1 and 2.

FIG. 3 shows an exploded view of the tubular members of the device, and shows container segment 14 and 15 and the connecting means. In this figure, the planar members 30 have associated with them the electrical connection 56 and valve assembly 60 shown in exploded perspective view.

FIG. 3 illustrates the relationship of the uppermost container segment 14 to the lowermost container segment 15. The uppermost and lowermost container segments are fixedly attached by means of a series of fastening devices shown in FIG. 7, the bolt 68, the washer 69, and the head or nut of the washer 70. The gasket 24 between the uppermost and lowermost tub units is made of a pliable, resilient material such as a foam plastic or foam rubber. The container segments are intended to be separable by means of disconnecting the attaching means 68, 69, and 70. Therefore a silicon caulk or other permanent glue or bonding material is inappropriate for attaching the container segments to each other.

The lowermost unit illustrated in FIG. 3 is shown in an exploded view above the transition means utilized for attachment to the apron surrounding the well opening 12. These transition means include a gasket 22, a reinforcing plate 23, and a series of attaching bolts 78, the attaching bolts being illustrated in FIG. 5. The transition means is connecting to the concrete, as illustrated in FIG. 6 showing concrete molly 25, gasket 22, reinforcing ring 21, gasket 22, and the annular flange 20.

On the lowermost unit is seen a series of raised planar surfaces 30 which can be adapted for the attachment of a clear plexiglass viewing area 80, a valve attachment assembly 60, or an electrical attachment assembly 56. The electrical and valve attachment assembly may be placed on any or all of the units so provided. The clear viewing window will be provided at one location on each container segment so that the water level within the device 10 may be easily ascertained by the user. In addition, if desired, a small electrical sensor 50 may be placed on the electrical attachment 49 so that when electrical power is interrupted, the valves on the device may be regulated so that water level within the device 10 does not exceed the capacity of the entire unit.

A cover 26 will be provided for maintaining the interior of the device in a clean condition, and further for containing the fluid within it should the capacity exceed the level of the uppermost valve assembly 60. This cover 26 will be designed in such a way that a template will be provided for creating an opening for the discharge pipe 48 from the sump system 41 and will also be provided with a resilient, pliable, gasket material 27 for maintaining a fluid tight seal between the cover 26, and the uppermost container segment 14. The cover 26 will be attached to the tubular member by means of bolt attachments such as illustrated by 28, attached in a like manner, as is seen in FIG. 7, passing through the uppermost surface of the cover, through the annular flange 23 attached by means of a screw and nut arrangement or other appropriate fastening means, as illustrated by 68, 69, and 70. The cover mechanism 26 will be enforced as appropriate to prevent undue bulging, and will be provided with an optional fluid-tight seal.

In FIG. 8, the fluid-tight seal for the discharge pipe 48 is shown illustrated by a reinforced coupling mechanism 80 held in place by bolts 68 passing through a gasket of resilient, pliable material 82 into the cover 26. This provides a watertight seal around discharge pipe 48 and prevents uncontrolled overflow through the cover 26 allowing the valve mechanism 60 to fully regulate discharge to the outside of the building, or to an appropriate sewer outlet, as is desired.

When the device is operational, the water will flow up the device 10 into the enclosure 19 to the level of the valve unit 60 from which it can directed to a sewer outflow, or to the outside of the structure, as is desired. This will result in a containment of overflow from the opening of the sump well 12 and will prevent an uncontrolled flow over the lip of the apron 11 to the floor of the structure 13, or portions of the structure surrounding the sump well opening.

In a like manner, the device may be employed over a sewer opening, and, in these instances, the sewer opening will be equally contained as is the sump well 12 and the apron of the sewer opening will be completely encased by the device 10, the apron 11 being contained wholly within the lowermost opening of the container segment 15. In these instances, drainage will be through valve unit 60 to the outside of the structure, or the device 10 may be employed as a temporary holding structure, for any fluid overflow from the sewer outlet, as is desired.

The device 10 is to be manufactured of a material such as polystyrene or polyethylene, and is to be manufactured by injection molding in such a manner that adequate reinforcement of the flanges 23 is accomplished by means of embedding a reinforcing member 20, or the like, into the molded structure. The gasket members 24 will be manufactured from a resilient, pliable material, such as foam rubber or foam plastic, which will be cut to a size equal to the area of the sealing surface 21 of the flange, and which will be marked for the installation of the attaching means as illustrated in FIG. 5, 6, and 7.

The sump pump is preferably of the immersible type, thereby allowing for the water level to rise to the level of valve opening 60 without causing water damage to the sump pump mechanism. A window, as is illustrated by 80 may be installed at the desire of the customer, and may be made of a clear plastic material, embedded within the raised planar surface 30 so as to allow viewing of the water level with ease. Thus, the level of ground water rise above the opening of the sump well 12 which would not be contained by the apron 11 is directed into the device 10.

The device is constructed so that the cross sectional area of each container segment is large enough to allow installation to cooperate with standard well opening. In addition, the cross sectional area of the device is large enough that it will easily cover a smaller sewer connection line. The device can be manufactured in a variety of diameters, including a standard size to fit over an 18 inch to 2½ foot diameter opening of a sump well. This unit offers a wide range of positioning flexibility in that it does not require a sump well or sewer line to be centered within the components of the invention. This will allow the unit to be offset to accomodate situations where the sump well opening or sewer line opening is positioned close to a wall, furnace, or other immovable structures within the building to be protected by the sump system backup.

The device is designed to cooperate with a variety of flooring materials which may be encountered around the sewer line opening or on the sump well apron, and has associated with it a thick, soft gasket at the floor interface with the device, thereby allowing the unit to be mounted onto a fairly irregular surface, and yet remain watertight. In the event that the floor is extremely uneven or gouged, it may be necessary to smooth the floor surface with a silicon caulking either before or after the installation of the container segment and attaching means, so that the seal will be fluid-tight.

Perfect leveling of the base of the structure to the floor is not necessary for the proper functioning of the device. However, a significant mounting angle should be avoided. This will allow a more even and controlled drainage from the device and while a significant mounting angle will not cause the device to malfunction, it will result in the device utilizing additional space that is unnecessary for the proper operation of the device.

The device should be mounted to a hard surface, thereby allowing the reinforcing mechanism of the device to coact with the gasket member and attaching means creating a fluid-tight seal. Therefore, any floor covering such as carpeting, irregular tile, or wooden floor covering should be removed from the immediate mounting area, although such floor covering may be reinstalled to fit around the base of the device for aesthetic reasons.

In normal sump situations, which is a preferred application of the invention, the sump pump is located in a sump well. A drain pipe is used to channel the water up and out of the well so that the sump liquid reaches the outside of the structure. The drainpipe may be channeled to an outside sewer line, at varying distances from floor level or the lowest level of the structure. At varying distances from the level of the sump pump, a one-way check valve is used to prevent expelled water from flowing back into the sump well or into the sump pump.

It is most common in areas where flooding is a regular occurence to utilize a submersible sump pump. This device, however is designed to work with a submersible or non-submersible sump pump in that it is designed to function when fluid inflow is too great for the sump pump. It will also function when there is a malfunction of the check valve which will result in the sump pump failing to pump the water any higher than the level of the sump pump itself, and therefore the pump will be functioning but the water level will not be receding.

This invention therefore will allow control of the water level during a flood situation, defined as any time the water level exceeds the upper level of the floor/well interface. In addition, the device will employ will a covering means, either a flat plate or other form of cover, which will have instructions accompanying it for the creation of a hole within it so that the drainpipe may pass from the sump well through the top of the device.

The device as illustrated, shows a multi-segment embodiment of the device. The lowermost segment alone may be sufficient for flood control. Add-on segments consist of a tubular member and a gasket attachment, all of identical dimensions as the base unit, and mounting means for attaching the device to the base unit. In addition to increasing the retention capacity of the add-on units, it is possible to construct the device so that the uppermost drain will be at the same level as the outside ground level of the structure, thereby allowing a gravity drain to empty the device in instance of sump pump failure.

The information contained in this disclosure and the description of the preferred embodiment of the device are for purposes of illustration only. Variations and permutations of the device as disclosed here will be apparent to persons skilled in the art. The disclosure is meant to be by way of illustration and not by limitation.

What is claimed is:

1. A flood control device to limit flooding from a drainage structure, sump well or the like, having an apron defining an opening and extending below a floor, the device being removeably and sealably installable on the apron and extending above the opening and the device comprising:

(a) an upper and a lower container segment, each segment including a tubular member having a top end, a bottom end and a substantially rigid sidewall between the two ends together defining an enclosure and the sidewall defining at least one raised planar surface, each container segment also including a top flange sealingly mounted on the top end and bottom flange sealingly mounted on the bottom end, said top and bottom flanges extending outwardly from the sidewall of the tubular member and each defining a sealing surface;

(b) a cover removeably and sealably mountable on said sealing surface defined by the top flange wherein said flange defines the sealing surface of the upper container segment;

(c) coupling means associated with the sealing surfaces of the bottom flange of the upper container segment and the top flange of the lower container segment for providing a liquid tight seal between the upper and lower container segments; and (d) attachment means associated with the bottom flange of the lower container segment for removeably and sealingly mounting the lower container segment on the apron about the opening whereby said device extends above the level of said floor to contain flooding from said sump well, drainage structure or the like in the event that the level of liquid within the sump well, the drainage or like structure exceeds the containment capacity of the drainage structure.

2. A flood control installation in a floor comprising:

(a) a sump well extending below the floor and opening through the floor through an apron;

(b) at least one container segment including a tubular member having a top end, a bottom end, and a substantially rigid sidewall together defining an enclosure, the container segment also including a top flange and a bottom flange, each flange extending from the sidewall to define a sealing surface;

(c) a cover sealingly mounted on the top flange;

(d) transition means associated with the bottom flange and sealably connecting the container segment to an element below the container segment wherein the element is another container segment or the apron;

(e) an outlet pipe extending through the flood control device; and (f) pump means located in the well for pumping water from the well out through the outlet pipe.

3. A flood control device to limit flooding from a well, having an apron defining an opening and extending below a floor comprising;

(a) two or more container segments being tubular members, each segment having two ends and a rigid sidewall between the two ends defining an enclosure, the sidewall of each tubular member having a plurality of raised planar surfaces, one planar surface having a drain valve attached thereto, one planar surface being adapted to accept an electrical connecting device such as a cord, a planar surface adapted to allow an observer visual access to the inside of the enclosure hereby permitting observation of fluid levels within the enclosure; the cross section of the enclosure definied by the sidewalls of each tubular member being equal to all other tubular members, the cross section of the enclosure defined by the sidewalls of each tubular member being greater than the cross section of the opening defined by the apron surrounding the well opening, each tubular member of the container structure also including a reinforced top, a reinforced top annular flange and a reinforced bottom annular flange, one flange at each end of each tubular member extending from the sidewall of the tubular member, each flange defining a sealing surface contiguous with the upper and lower ends of the tubular member, each sealing surface being contiguous with a resiliently pliable scaling means;

(b) a cover where the cross section of the cover is of sufficient size to seal the uppermost opening defined by the sidewalls of the uppermost tubular member;

(c) mounting means removably mounting the cover to the uppermost flange in a sealed manner, of the uppermost tubular member, the mounting means providing a fluid tight seal.

(d) transition means associated with the bottom flange of the lowermost tubular member, to seal with the element below it, the element below being the apron defining the opening of the sump well;

(e) transition means associated with the bottom flange of the tubular member, to seal with the element below it, the element below being a tubular member.

4. A flood control device to limit flooding or overflow from a drainage structure defined by a well having an apron defining an opening, the device being removably and sealingly mounted above the opening of the well, the device comprising:

(a) at least one container segment including a tubular member having a top end, a bottom end, and a substantially rigid sidewall between the ends with at least one raised planar surface, the tubular member defining an enclosure, the container segment also including a top flange and a bottom flange each flange defining a sealing surface contiguous with the tubular member;

(b) a cover having a cross section of sufficient size to seal with the top flange;

(c) means for removably mounting the cover to the top flange; and (d) separate transition means associated with the bottom flange to sealably connect the container segment with an element below the container segment, wherein the element is another container segment or the apron, whereby the container structure is removeably and sealingly placed above a well opening such that when an influx of liquid into the well exceeds the capacity of the drainage structure, the liquid inflow is directed into the enclosure of the device, wherein the additional storage capacity of the device prevents discharge of liquid from the well to the area surrounding the apron subject to the flood damage.

5. The flood control device of claim 4 wherein the tubular member has a generally circular cross section.

6. The flood control device of claim 4 wherein the tubular member is constructed of a molded plastic material.

7. The flood control device of claim 4 wherein the tubular member is constructed of a fiber glass reinforced thermosetting polyester material.

8. The flood control device of claim 4 including a second container segment and coupling means for connecting the two container segments in a sealable vertical relationship.

9. The flood control device of claim 4 wherein the height of the container segments are different.

10. The flood control device of claim 5 including at least one outlet valve mounted on the sidewall of the container segment, the outlet valve position defined by a planar surface.

11. The flood control device of claim 4 wherein the planar surface includes a template defining a cutout area.

12. The flood control device of claim 4 wherein the flange extends outwardly of the tubular member sidewall.

13. The flood control device of claim 4 wherein the flange extends inwardly of the tubular member sidewall.

14. The method for preventing well overflow comprising fluid tight means to contain overflow from well; comprising one or more open ended tubular members stackably arranged; means to fixedly attach the tubular members to the well having an apron defining an opening whereby the cross sectional area of the container means is greater than the cross sectional area defined by the opening of the well, means to fixedly attach the tubular members in connection with other tubular members in a fluid-tight manner, means to fixedly attach the tubular members to the apron defining the opening of the well whereby the device is fluid tight, means to store fluid within the stackably arranged tubular members.

15. The method of claim 14 also comprising means to release fluid from the inside of the device comprising a valve mechanism cooperating with at least one tubular member of the container structure.

* * * * *